United States Patent [19]

Graham

[11] 4,295,543

[45] Oct. 20, 1981

[54] FIRE ESCAPE APPARATUS

[76] Inventor: Finlay M. Graham, The Coach House, High Rocks La., Tunbridge Wells, England

[21] Appl. No.: 119,086

[22] Filed: Feb. 6, 1980

[51] Int. Cl.[3] ..... A62B 1/20

[52] U.S. Cl. ..... 182/3; 46/130

[58] Field of Search ..... 182/3, 4, 5, 6, 7; 46/130, 132

[56] References Cited

U.S. PATENT DOCUMENTS

| | | | |
|---|---|---|---|
| 607,161 | 7/1898 | Conaway | 182/5 |
| 1,276,561 | 8/1918 | Nelson | 46/130 |
| 2,313,158 | 3/1943 | Long | 46/130 |
| 3,944,021 | 3/1976 | Smith | 182/3 |
| 4,125,172 | 11/1978 | Hatala | 182/3 |

*Primary Examiner*—Reinaldo P. Machado

[57] ABSTRACT

A fire escape apparatus comprises a vertically extending channel member defining a channel into which opens a slot formed between flanges constituting a front wall of the channel member. Rows of staggered projections within the channel are formed by bolts extending between the flanges and a rear wall of the channel member. A harness for supporting a person escaping in the event of fire or other emergency is suspended from a T-shaped support including a cross-piece, and an upright. In use, the cross-piece and upright are introduced into the channel through the slot. A lug on the upright projects through the slot and limits side-to-side movement as the harness support descends under the weight of the person escaping, the cross-piece co-operating with the bolts to perform a stepping movement.

5 Claims, 5 Drawing Figures

FIG.1.
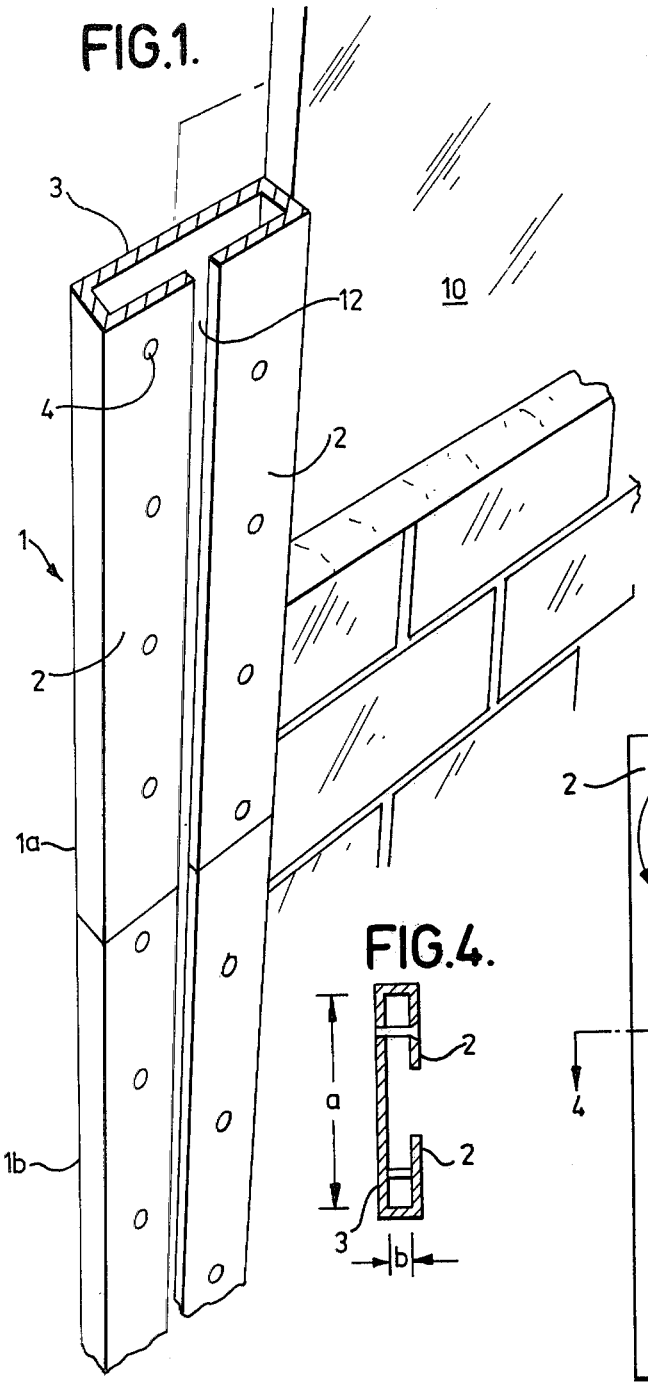
FIG.2.
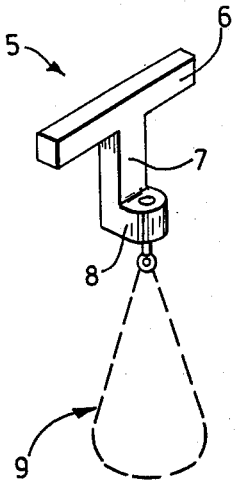
FIG.4.
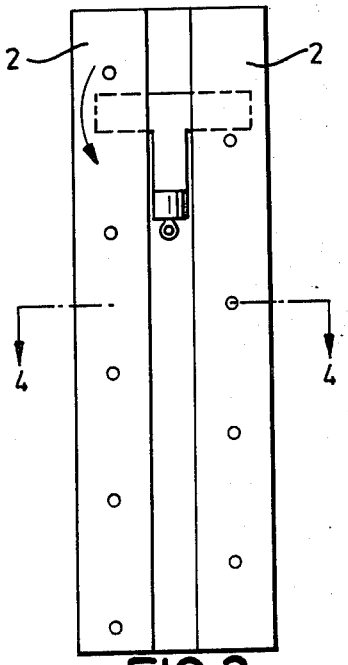
FIG.3.

FIRE ESCAPE APPARATUS

BACKGROUND OF INVENTION

1. Field of Invention

This invention relates to a fire escape apparatus.

2. Description of Prior Art

Many buildings must by law be provided with means permitting escape by occupants in the event of fire or other emergency. The traditional form of fire escape is a stairway external of the building but this cannot be used by those with a fear of height, the unconscious or by invalids. Escape by such a stairway may also be prevented by the fire spreading to the part of the building at which it is located. Another form of fire escape apparatus includes a harness which is worn by a person escaping from the building. The harness is attached to a cable which is paid out to lower the person wearing the harness to the ground. Although such an apparatus does allow an unconsious person to escape, the lowering operation must generally be controlled by another person. The risk also exists that the apparatus will jam, or the person descending will foul an obstruction. It is also impossible for a number of people to use such an apparatus simultaneously.

SUMMARY OF INVENTION

An object of this invention is to provide a fire escape apparatus which is simple to construct and to install in a building of any height, reliable in operation, and which can be used to remove persons who are unconscious or have such a fear of height that they might be incapable of descending by a conventional fire escape staircase.

According to the invention, a building incorporates or has attached to it a channel member defining a channel into which opens a slot formed between flanges. Rows of staggered projections within the channel are formed by bolts extending between the flanges and the rear of the channel member. A harness for supporting a person escaping in the event of fire is suspended from a support including a cross-piece and an upright. In use, the cross piece and upright are introduced into the channel through the slot. A lug on the upright projects through the slot and limits side-to-side movement as the harness support descends under the weight of the person escaping. During descent, the cross-piece co-operates with the bolts to perform a stepping movement.

BRIEF DESCRIPTION OF THE DRAWINGS

FIG. 1 is a perspective view showing the channel member in position against the wall of a building.

FIG. 2 is a perspective view of the harness support,

FIG. 3 is a front elevation of the channel member with the harness support in position, FIG. 4 is a section taken on the line 4—4 in FIG. 3.

DESCRIPTION OF PREFERRED EMBODIMENT

Figure 5:
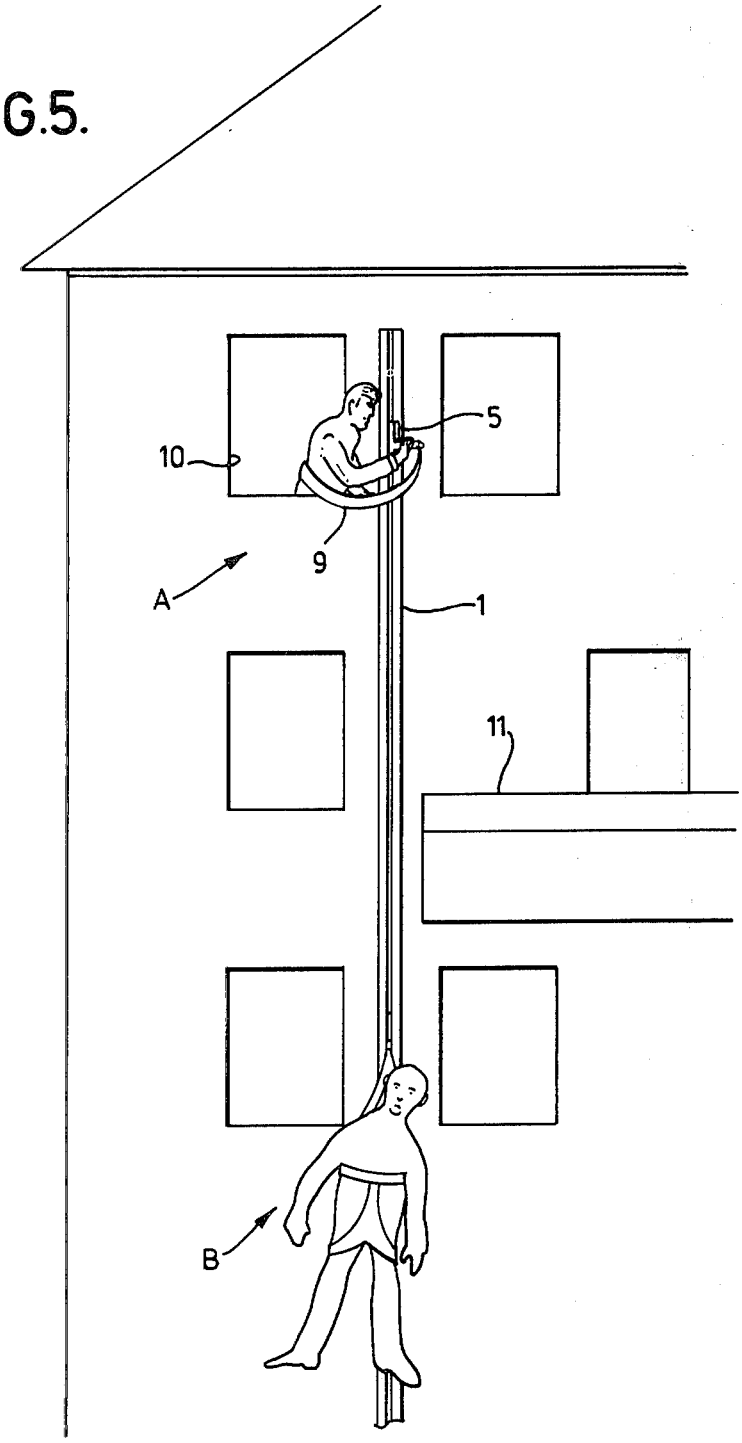
FIG. 5 is a view to a smaller scale of a building equipped with apparatus in accordance with the invention, the apparatus being in use.

Referring to the drawings, a multi-storey building is equipped with at least one vertically extending channel member 1 located so as to extend adjacent to a window 10 or balcony 11 each floor of the building. The channel member 1 may be bolted in place to the wall of an existing building or it may be possible for the channel member to be recessed into the wall of a building of suitable type. Of course, the building may incorporate several pieces of escape apparatus in accordance with the invention and the arrangement may be such that some floors are served by one such apparatus, and other floors by another. The channel member 1 may be made from a number of sections 1*a*, 1*b*, each of which may consist of a "c" section rolled steel girder or it may be fabricated by bending sheet metal to shape. The channel defined by the channel member is of rectangular cross-section and has opening into it a slot 12 formed in the wider front face of the member which faces away from the building. The major cross-sectional dimension of the channel (dimension "a" in FIG. 4) may be about six inches while the minor dimension ("b" in FIG. 4) may be about three-quarters of an inch. The channel member is therefore no more obstrusive than a drain pipe. The flanges 2 by which the slot is defined and the rear wall 3 of the channel member are drilled or otherwise formed with holes to receive two rows of bolts 4. As shown in FIGS. 1 and 3, the bolts in one row are staggered relative to those in the other. The holes in the flanges are counter-sunk to ensure that the heads of the bolt lie flush with the front faces of the flanges. Some of the bolts may extend beyond the rear wall 3 and be used to secure the channel member in place. Alternatively, other fixing means may be used for this purpose. In a modification, each bolt is provided with a sleeve located within the channel.

The apparatus also includes at least one harness support 5 in the form of a "T"-shaped bar with a cross piece 6 and an upright 7 which terminates at its lower end in a lug or projection 8 which is adapted to support a harness 9. In practice, a suitable number of harness supports each with its harness is provided on each floor of the building adjacent to the window 10 or balcony 11 nearest to the channel member. A suitable rack may be provided for this purpose.

The harness support is so dimensioned that the cross-piece may be inserted into the channel of the channel member through the slot therein (as at "A" in FIG. 5) and the support twisted into the position shown in FIG. 3. The person intending to escape may then don the harness (if he has not already done so) and climb out of the window or from the balcony. In its initial position, one of the arms of the cross-piece is lodged on a bolt in one of the rows. The weight of the person escaping causes the harness support to swing in the direction of the arrow in FIG. 3. This movement is limited by contact of the lug or projection 8 with the edge of one of the flanges. The other arm of the cross-piece comes to rest on a bolt in the other row, and the harness support progresses down the channel with a form of rocking motion in which the cross-piece steps from bolt to bolt under the weight of the person using the apparatus, as at "B" in FIG. 5. Various factors control the speed at which the harness support descends. These include the weight of the person escaping, the coefficient of friction between the harness support and the bolts and the spacing of the bolts in each row.

As indicated in FIG. 5, the apparatus may be used by several persons at the same time. The overall arrangement is such that the harness support descends at a speed less than that which could cause injury to the person escaping when he reaches the ground or makes contact with another person. Since the lug or projection 8 protudes from the slot in the channel member, very little lateral movement of this part takes place. The vertical force applied by the weight of the person escaping is, as a result, never directly beneath a bolt and the resulting forces have a lateral component when the cross-piece is in contact with one of the bolts which prevents the harness support remaining stationary. Since the cross-piece of the harness support is sufficiently long to prevent either end coming into line with the slot, the cross-piece cannot escape from the channel.

The arrangement is such that the harness support will not begin to descend until the weight of the person escaping hangs vertically therefrom, i.e. after he has jumped from the window or balcony.

In a modification, not illustrated, the bolts are omitted and their function served by projections on the inner face of the shorter walls of the channel member. In another modification, the lug 8 is adjustable relative to the upright 7 (or the upright adjustable relative to the cross-piece) to enable the speed of descent to be controlled. Although the apparatus provided by the invention is primarily intended for use as a fire escape apparatus, it may be used for permitting the descent of persons in other situations or for lowering loads generally, in which case the channel need not be carried by a wall of a building.

What is claimed is:

1. In a building, a fire escape apparatus comprising a vertically extending channel member secured to a wall of the building, the channel member defining a channel into which opens a vertical slot, two vertical rows of projections within the channel, each row being disposed adjacent a respective side of the slot and the projections in each row being staggered with respect to those in the other, and at least one harness support capable of being introduced into the channel through the slot and of co-operating with the projections so as to move step-wise down the channel member under the effect of the load applied to the harness support, said harness support including a "T"-shaped member having a cross-piece surmounting an upright, the upright having a projection to which the harness is attached.

2. A fire escape apparatus as claimed in claim 1, wherein the slot is defined between flanges which form a front wall of the channel member and the projections are formed by bolts which pass through holes in the flanges and in a rear of the channel member.

3. A fire escape apparatus as claimed in claim 1, wherein the width of the channel in the plane of the slot is substantially greater than the width of the channel perpendicular to the plane of the slot.

4. A fire escape apparatus as claimed in claim 1, wherein the projection of the harness support passes through the slot during operation of the apparatus and limits side-to-side movement of the harness support.

5. In a building, an escape apparatus comprising a vertically extending channel member having a rear wall and a front wall defined by flanges between which is formed a slot, a row of projections disposed within the channel behind each flange, the projections in each row being staggered relative to those in the other, and a harness support member of "T"-shape with a cross-piece for co-operation with the projections, an upright connected to the cross-piece and a lug projecting from the upright and adapted to co-operate with the edges of the flanges by which the slot is defined, thereby to permit limited lateral movement of the harness support whereby the harness support may co-operate with the projections to perform a stepping movement under the action of weight applied to said support.

* * * * *